United States Patent [19]

Saito et al.

[11] Patent Number: 4,980,036

[45] Date of Patent: Dec. 25, 1990

[54] ULTRASONIC MACHINING METHOD

[75] Inventors: Nagao Saito, No. 12-12, Iwanaridai 9-chome, Kasugai-shi, Aichi; Naotake Mohri, Nagoya, both of Japan

[73] Assignees: Mitsubishi Denki Kabushiki Kaisha, Tokyo; Nagao Saito, Aichi, both of Japan

[21] Appl. No.: 323,908

[22] Filed: Mar. 15, 1989

[30] Foreign Application Priority Data

Mar. 15, 1988 [JP] Japan ..... 63-60761

[51] Int. Cl.[5] ..... C25B 1/02; B23H 1/08; B23H 3/08; B23H 5/04

[52] U.S. Cl. ..... 204/129; 204/129.46; 204/129.7; 204/129.75; 219/69.14; 219/69.17

[58] Field of Search ..... 204/222, 129.1, 129.46, 204/129.7, 129.75, 129, 69.17; 219/69 M, , 69.14; 51/59 SS, 322

[56] References Cited

U.S. PATENT DOCUMENTS

| | | | |
|---|---|---|---|
| 2,736,148 | 2/1956 | Thatcher | 51/59 SS |
| 2,804,724 | 9/1957 | Thatcher | 51/59 SS |
| 3,252,881 | 5/1966 | Inoue | 204/222 |
| 3,271,283 | 9/1966 | Clifford et al. | 204/129.7 X |
| 3,280,016 | 10/1966 | Bass et al. | 204/222 X |
| 3,284,327 | 11/1966 | Maeda et al. | 204/278 X |
| 3,438,428 | 4/1969 | Balamuth et al. | 51/59 SS X |
| 3,533,928 | 10/1970 | Inoue | 204/129.46 |
| 3,717,567 | 2/1973 | Bodine | 204/222 |
| 4,214,952 | 7/1980 | Sato et al. | 204/129.1 X |
| 4,414,456 | 11/1983 | Inoue | 219/69.14 X |
| 4,508,950 | 4/1985 | Inoue | 219/69.17 X |

*Primary Examiner*—Donald R. Valentine

*Attorney, Agent, or Firm*—Sughrue, Mion, Zinn, Macpeak & Seas

[57] ABSTRACT

An ultrasonic machining method comprises the steps of causing a machining solution to readily produce a gas in the machining solution, supplying the machining solution around a workpiece to be machined, and producing an ultrasonic vibration to carry out an ultrasonic machining operation, wherein the gas is produced during the machining operation so that a machined surface of the workpiece is prevented from being degraded by the occurrence of cavitation. An ultrasonic machining apparatus comprise a heater for heating the machining solution or a DC power source for electrolyzing the machining solution.

13 Claims, 3 Drawing Sheets

ULTRASONIC MACHINING METHOD

BACKGROUND OF THE INVENTION

This invention relates to an ultrasonic machining method and apparatus, and particularly to an ultrasonic abrasive grain machining method and apparatus of machining fine ceramics or the like, or to an ultrasonic discharge machining method and apparatus of machining hard materials.

In a conventional abrasive grain machining method or electric discharge machining method utilizing ultrasonic vibration, a machining solution is used at room temperature under atmospheric pressure. Therefore, when the amplitude of ultrasonic vibration is increased to improve the machining efficiency, cavitation (formation of substantially vacuum bubbles) is liable to occur, thus engraving the machined surface in such a manner that small pits are linked therein so that the working accuracy or smoothness of the finished surface is reduced.

The reason for this is as follows: When the vibrating tool is quickly moved up and down while ultrasonic vibration is given to the solution, the solution tends to flow following the movement of the tool. If it flows at high speed, then pressure difference occurs in the solution; i.e., its part of higher flow speed is lower in pressure (Bernoulli's law).

The ultrasonic vibration is, in general, of the order of 20 KHz. If, in this case, the amplitude is 30 $\mu$m (full amplitude), then a considerably large acceleration of the order of $450\times10^3$ m/s$^2$ occurs at the maximum amplitude point, resulting in the occurrence of cavitation which is great beyond comparison with that which occurs with a pump or cascade of blades.

Vacuum cavities formed by cavitation produce a great force of suction when collapsed. The force of suction thus produced may provide an ultrasonic cleaning effect; however, in a machining operation, it will suck weak brittle crystal particles out of the grain boundary, as a result of which the machined surface is made uneven, or pitted.

Conventionally, in order to overcome the above-described difficulty, the amplitude is decreased thereby to decrease the machining speed, or nothing has been done; that is, the drawback is accepted as unavoidable.

When cavitation occurs as described above, in an ultrasonic machining operation, a brittle material such as semi-sintered material will be greatly engraved.

On the other hand, in an ultrasonic discharge machining operation, a finely machined surface can be obtained with high efficiency; however, arc marks are liable to be formed at the point where cavitation occurs, which obstructs practical application of the operation.

SUMMARY OF THE INVENTION

Accordingly, an object of this invention is to provide an ultrasonic machining method and apparatus in which the occurrence of cavitation is prevented without decreasing the amplitude of a vibrating tool and the machining speed.

In an ultrasonic machining method according to the present invention, the machining solution is made to readily produce gas both in an ultrasonic abrasive grain machining operation and in an ultrasonic discharge machining operation. More specifically, in the method, gas is produced in the machining solution by, for instance, dissolving water-soluble carbon dioxide gas in the solution previously, or by chemical reaction or by electrolysis.

Further in the method, the machining solution is heated near to the boiling point, to produce gas (or vapor).

Production of the gas during a machining operation means that the engraving pressure due to vacuum cavities formed by cavitation can be reduced. That is, the vacuum cavities formed by negative pressure provide a high pressure when collapsed, however, if material which is readily gasified is mixed with the solution, or the latter itself is made to be gasified with ease, then the engraving marks hardly occur because the gas whose pressure is substantially equal to atmospheric pressure is produced to prevent the formation of the vacuum cavities.

An ultrasonic machining apparatus of the present invention comprises a heater for heating the machining solution or a DC power source for electrolyzing the machining solution.

DETAILED DESCRIPTION OF THE PREFERRED EMBODIMENTS

Embodiments of this invention will be described with reference to the accompanying drawings.

Figure 1:
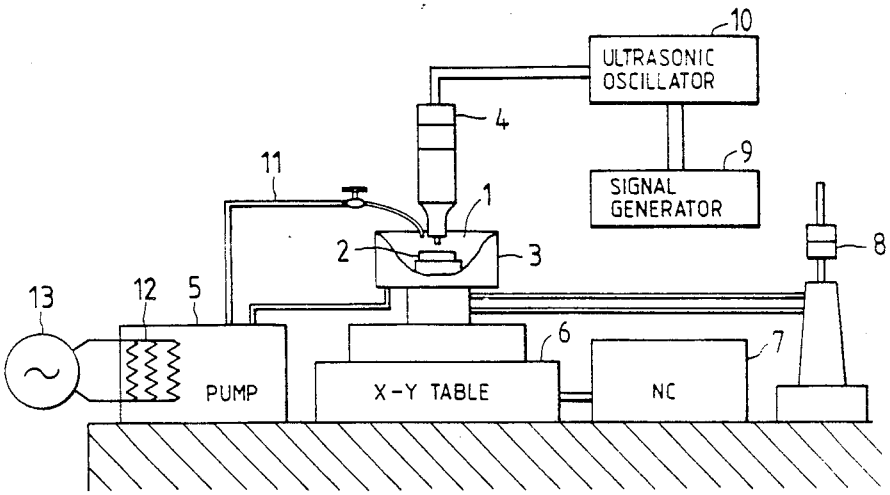
FIG. 1 is an explanatory diagram showing the arrangement of an ultrasonic machining apparatus according to the present invention.

FIG. 1 shows the arrangement of an ultrasonic machining apparatus. In the apparatus, a vibrating tool 1 is pushed against a workpiece 2 through a machining stand 3 by a hydraulic device 8. Under this condition, a signal generator 9 and an ultrasonic oscillator 10 operate in combination to vibrate an ultrasonic vibrator 4, while an abrasive grain pump 5 applies abrasive grains to the workpiece, whereby machining is carried out. An X-Y table 6 and an NC (numerical control) device 7 are used to shift the machining point or to turn the workpiece. This is the arrangement of a conventional ultrasonic machining apparatus.

In one embodiment of this invention, in addition to the above-described components, a device for heating mixture of abrasive grains and a machining solution with an electric heater 12 is provided. The mixture, after being heated to about the boiling point, is supplied through a hose 11 to the space between the workpiece and the vibrating tool, to prevent the occurrence of cavitation during the machining operation.

Figure 2:
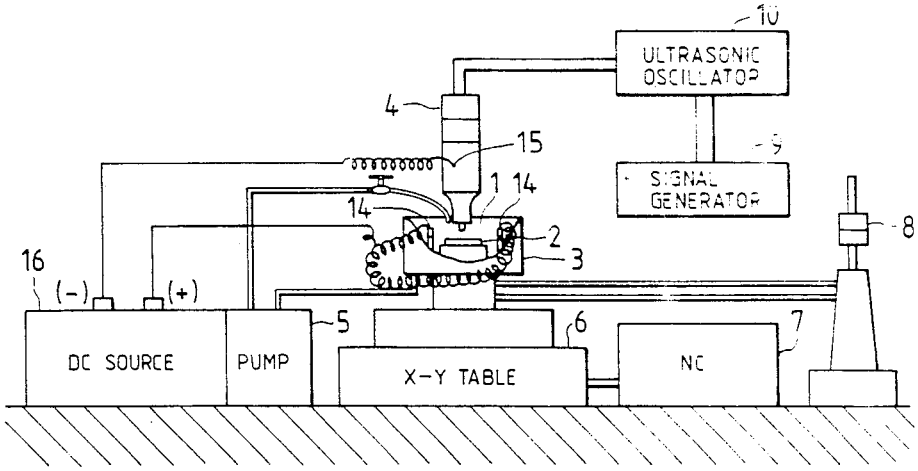
FIG. 2 is an explanatory diagram showing the arrangement of an ultrasonic machining apparatus in which a vibrating tool is caused to produce hydrogen gas by electrolysis according to the present invention.

FIG. 2 shows the arrangement of an ultrasonic machining apparatus in which its vibrating tool produces hydrogen gas by electrolysis. In FIG. 2, reference numeral 14 designates anodes; 15, a cathode junction; and 16, a DC source.

One example of the machining conditions with the apparatus of FIG. 1 is as follows:

Workpiece: Temporarily sintered alumina ceramics ($Al_2O_3$ powder sintered at 1300° C.). Its hardness is lower than that of completely sintered (at 1600° C.) alumina ceramics, but the machining speed is several tens of times as high as that for the latter. The temporarily sintered alumina ceramics is machined with considering the amount of contraction, and then completely sintered.

Machining solution: Prepared by mixing water and green caborundum (#220) in a rate of 40 g/l.

Solution temperature: When it was at room temperature, uneven pitted surfaces were formed. When boiled water was used, no uneven pitted surfaces were formed.

In another example, the electric heater 12 and power source 13 in FIG. 1 were not used, and instead a mixture of carbonated water (prepared by saturating water with carbon dioxide gas) and abrasive grains was used. In this case, it was found that the effect was substantially equal to that of the above-described case using the boiled water.

In one modification of the above-described machining apparatus, water which was saturated with a mixture prepared by mixing carbonate such as sodium bicarbonate and acid (tartaric acid in this case) in a weight ratio of 1:0.2, was used. In this case, substantially the same effect as that in the case of the boiled water was obtained.

In the arrangement of an ultrasonic machining apparatus of FIG. 2, a tool electrode was employed as a cathode, and iron plates of an anode were put in a machining tank. The machining solution was mixed with sodium nitrate, thus forming electrolyte, and electric current was applied to the electrodes while an ultrasonic machining operation was carried out. In this case also, the effect was substantially the same as that in the case of the boiled water in FIG. 1.

Mixing of air in the solution also provides an effect, however the amount of dissolution is small.

Another embodiment of the invention in which the technical concept of the present invention is applied to an electric discharge machining operation utilizing an ultrasonic technology, will be described.

Figure 3:
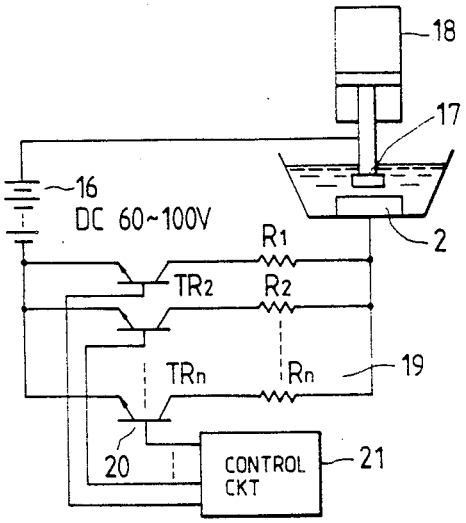
FIG. 3 is an explanatory diagram showing the arrangement of an electric discharge machining transistor power circuit.

FIG. 3 is an explanatory diagram showing an ordinary electric discharge machining power source circuit, electrodes, and a workpiece to be machined.

In FIG. 3, reference numeral 2 designates a workpiece to be machined; 16, a DC source; 17, an electrode, 18, a hydraulic servo mechanism; 19, resistors; 20, transistors; and 21, a power control circuit.

Figure 4:
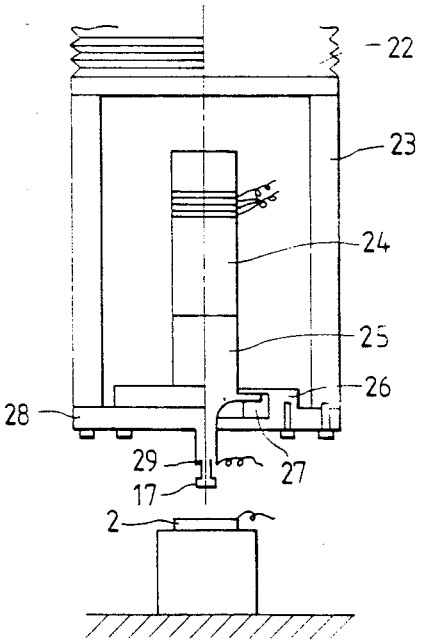
FIG. 4 is an explanatory diagram showing the relation between an electric discharge machining power source circuit and a workpiece to be machined.

An electric discharge machine utilizing an ultrasonic technology is as shown in FIG. 4, and it is attached to the electrode 17 in FIG. 3.

In FIG. 4, reference numeral 2 designates a workpiece to be machined; 17, an electrode; 22, an electric discharge machine spindle; 23, supports; 24, an ultrasonic vibrator; 25, an amplitude amplifying horn; 26, a fixing plate; 27, a fixing ring; 28, a base plate; and 29, an electrode fixing nut.

Figure 5:
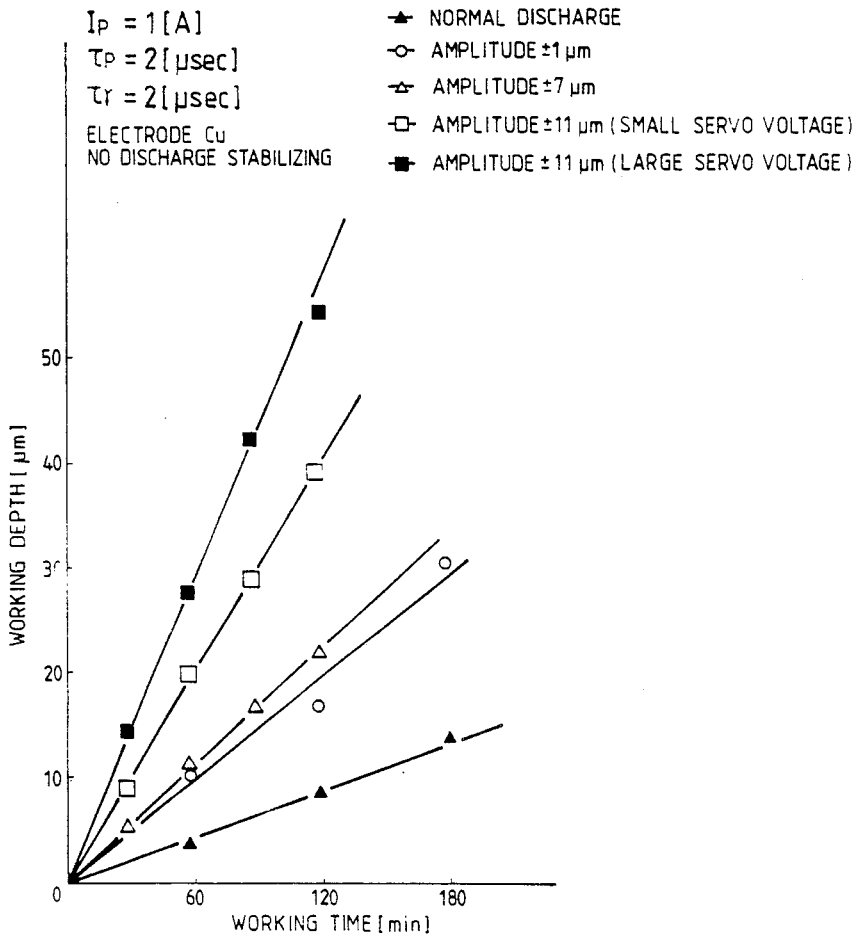
FIG. 5 is a graphical representation indicating the relation between machining time and machining depth in an electric discharge machining operation utilizing ultrasonic vibration.

When an electric discharge machining operation is carried out by using ultrasonic vibration, the machining speed is increased. That is, as shown in FIG. 5, in the case where it is required to provide the best finished surface roughness with current $Ip=1$ A and $\tau P=2$ μs; with an ultrasonic amplitude ±1 μm (2 μm in maximum), the machining speed is two times as high as that in the ordinary case, and with an ultrasonic amplitude ±11 μm, it is about six times.

However, as the amplitude increases, the engraving due to cavitation occurs on the workpiece and this tendency becomes significant as the area increases, because the part of the workpiece which suffers from cavitation is greatly sucked and it is not sufficiently recovered in insulation. In this connection, it has been found that, when the machining solution heated to about 100° C. is used, the workpiece free from the engraving marks is obtained. And, it is also effective to diffuse carbon dioxide gas in the solution near the electrodes. In the case of an aqueous machining solution, carbonated water and chemical reaction can be utilized.

As was described above, according to the invention, in the abrasive grain machining method or electric discharge machining method utilizing an ultrasonic technology, the machining solution is heated, or it is made to absorb a gas in advance. As a result, during the machining operation, gas is readily produced to prevent the machined surface from being degraded by the occurrence of cavitation. Thus, according to the invention, the machining operation can be carried out with high quality and with high efficiency.

What is claimed is:

1. An ultrasonic machining method, comprising the steps of:

preparing a machining solution to readily produce a gas in said machining solution;

heating said machining solution;

supplying said heated machining solution around a workpiece to be machined; and producing an ultrasonic vibration to carry out an ultrasonic machining operation;

wherein said gas is produced during the ultrasonic machining operation so that cavitation is minimized and degradation of machined surface of said workpiece due to the occurrence of cavitation is prevented.

2. An ultrasonic machining method as claimed in claim 1, further comprising the step of mixing abrasive grains with said machining solution.

3. An ultrasonic machining method as claimed in claim 2, wherein said machining solution is heated to a temperature near a boiling point of said machining solution.

4. An ultrasonic machining method as claimed in claim 1, wherein an electric discharge is produced.

5. An ultrasonic machining method as claimed in claim 4, wherein said electric discharge and said ultrasonic vibration are simultaneously used to carry out the ultrasonic machining operation.

6. An ultrasonic machining method, comprising the steps of:

preparing a machining solution to readily produce a gas in said machining solution;

mixing abrasive grains with said machining solution;

heating said machining solution mixed with said abrasive grains so as to readily produce said gas;

supplying said machining solution to the interface between said tool and said workpiece to be machined; and producing an ultrasonic vibration to carry out an ultrasonic abrasive grain machining operation;

wherein said gas is produced during the ultrasonic abrasive grain machining operation so that cavitation is minimized and degradation of a machined surface of said workpiece due to the occurrence of cavitation is prevented.

7. An ultrasonic machining method as claimed in claim 6, wherein said machining solution is electrolyzed to produce hydrogen gas from a vibrating tool.

8. An ultrasonic machining method as claimed in claim 6, wherein carbon dioxide is absorbed in said machining solution prior to the mixing step so as to readily produce said gas.

9. An ultrasonic machining method as claimed in claim 6, wherein said machining solution is prepared by saturated water with a mixture including carbonate and acid in a weight ratio of 1:0.2 so as to readily produce said gas.

10. An ultrasonic machining method as claimed in claim 9, wherein said carbonate is sodium bicarbonate.

11. An ultrasonic machining method as claimed in claim 9, wherein said acid is tartaric acid.

12. An ultrasonic machining method as claimed in claim 6, wherein said machining solution is mixed with sodium nitrate and is applied an electric current so as to produce said gas.

13. An ultrasonic machining method as claimed in claim 6, wherein said machining solution is heated to a temperature near a boiling point of said machining solution.

* * * * *